US006902165B1

(12) United States Patent
Hunt et al.

(10) Patent No.: US 6,902,165 B1
(45) Date of Patent: Jun. 7, 2005

(54) METHOD FOR PLAYING VARIATIONS OF CHESS

(76) Inventors: Thomas C. Hunt, 2120 Hwy. 89A, Sedona, AZ (US) 86336; Thomas C. J. Hunt, 2120 Hwy. 89A, Sedona, AZ (US) 86336

( * ) Notice: Subject to any disclaimer, the term of this patent is extended or adjusted under 35 U.S.C. 154(b) by 203 days.

(21) Appl. No.: 10/055,043

(22) Filed: Jan. 23, 2002

(51) Int. Cl.[7] ..... A63F 3/00
(52) U.S. Cl. ..... 273/261; 273/236; 273/242
(58) Field of Search ..... 273/260–262, 273/258, 287, 293, 242, 241, 283

(56) References Cited

U.S. PATENT DOCUMENTS

| | | | | | |
|---|---|---|---|---|---|
| 4,696,478 | A | * | 9/1987 | Farrell | 273/261 |
| 4,708,349 | A | * | 11/1987 | Shomer | 273/261 |
| 4,932,669 | A | * | 6/1990 | Perry | 273/261 |
| 5,125,666 | A | * | 6/1992 | Adams | 273/261 |
| 5,275,414 | A | * | 1/1994 | Stephens et al. | 273/261 |
| 5,280,913 | A | * | 1/1994 | Sirk | 273/261 |
| 5,513,849 | A | * | 5/1996 | Navin | 273/261 |
| 5,586,762 | A | * | 12/1996 | Wearley | 273/261 |
| 5,749,583 | A | * | 5/1998 | Sadounichvili et al. | 273/261 |
| 5,954,333 | A | * | 9/1999 | Vilches Guerra | 273/261 |
| 6,102,399 | A | * | 8/2000 | Kifer | 273/261 |
| 6,116,602 | A | * | 9/2000 | McLoy | 273/261 |
| 6,478,300 | B1 | * | 11/2002 | Pickett | 273/260 |

FOREIGN PATENT DOCUMENTS

GB 2201351 A * 9/1988 ..... A63F/3/02

OTHER PUBLICATIONS

Doug Vogel, Chess on a 12 by 12 board, Dec. 13, 2000€€Website: chesvariants.com.*

E. Nebermann, The piecelopedia: Berolina Pawn, 1926€€Website:chessvariants.com.*

Doug Vogel, Chess on a 12 by 12 board, Dec. 13, 2000€€Website:WWW.chesvariants.com.*

E. Nebermann, The piecelopedia: Berolina Pawn, 1926€€Website:wwwchesvariants.com.*

The Chess Varian Pages: Index€€Website:www.chesvariants.com.*

John Gollon, Chess Variations Ancient, Regional, and Modern, Published by Charles E. Tuttle Company, Inc. Copyright in Japan, 1968, 6 pages.*

* cited by examiner

*Primary Examiner*—Jessica Harrison
*Assistant Examiner*—Alex F. R. P. Rada, II
(74) *Attorney, Agent, or Firm*—Ted Masters

(57) ABSTRACT

Methods for playing variations of the game of chess include a playing area having 144 playing stations arranged in a 12 by 12 matrix. Two, three, or four players can utilize the playing area to play a game of chess. The game may be played using common chess pieces of a "phantom" player, wherein the real players take turns moving the common chess pieces. In a preferred playing embodiment, when a player is checkmated, all of the players chess pieces are removed from the playing area. In another preferred embodiment, when a player is checkmated, only the checkmated player's king is removed from the playing area, with all the other chess pieces of the checkmated player remaining immobile on playing area. In another preferred embodiment, one or more master pawns may replace conventional pawns. The master pawns move diagonally and capture straight ahead.

17 Claims, 10 Drawing Sheets

METHOD FOR PLAYING VARIATIONS OF CHESS

TECHNICAL FIELD

The present invention is directed generally to the game of chess, and more particularly to modified methods of playing the game.

BACKGROUND OF THE INVENTION

Chess is one of the oldest games in the world. No one knows exactly when or where the game of chess began. The best records point to a middle eastern or far eastern origin, wherein the game entered Europe through Spain via Africa. From that point, the game rapidly spread throughout all of Europe. Chess is a direct reflection of medieval times. The various chess pieces represent medieval life with its grandeur, social ranking, and conflict. The chess pieces range from the lofty King and Queen, to the lowly serfs which are represented by pawns. The game is played upon a board having 64 squares of two alternating colors. At the start of the game, the pieces of each player are arranged on opposite sides to the board, with the pawns forming a forward rank. Today chess is played by millions of people worldwide. The United States Chess Federation is a major governing body for chess played in the United States.

SUMMARY OF THE INVENTION

The present invention is directed to methods for playing variations of the game of chess. All of the embodiments of the present invention are played on a playing area (chess board) which has 144 playing squares arranged in a 12 by 12 matrix. The methods of the present invention include;

- a four player game;
- a three player game using a fourth common set of chess pieces called a "phantom" player;
- a three player game with no "phantom" player;
- a two player game using two "phantom" players;
- a two player game wherein each player has two sets of chess pieces, except each player only has one king and one queen;
- a two player game wherein each player has two complete sets of chess pieces, including two kings and two queens;
- a two player game in which the starting position of the player's chess pieces is moved forward two rows;

Unique features of the present invention include:

- a king may be put into checkmate by the chess pieces of multiple players (including "phantom" players);
- when a king is checkmated, all of the chess pieces of the checkmated player are removed from the playing area, or when a king is checkmated only the king is removed from the playing area with all other chess pieces of the checkmated player remaining in place on the playing area;
- one or more conventional pawns may be replaced by master pawns, the master pawns moving diagonally one space (optionally two spaces on the first move), and capturing one space straight ahead (forward);
- four corner areas of four squares each of the playing area cannot be occupied by the chess pieces of any player; and,
- in a multiple player game, if a player is checkmated, the checkmate may be removed by an intervening player.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
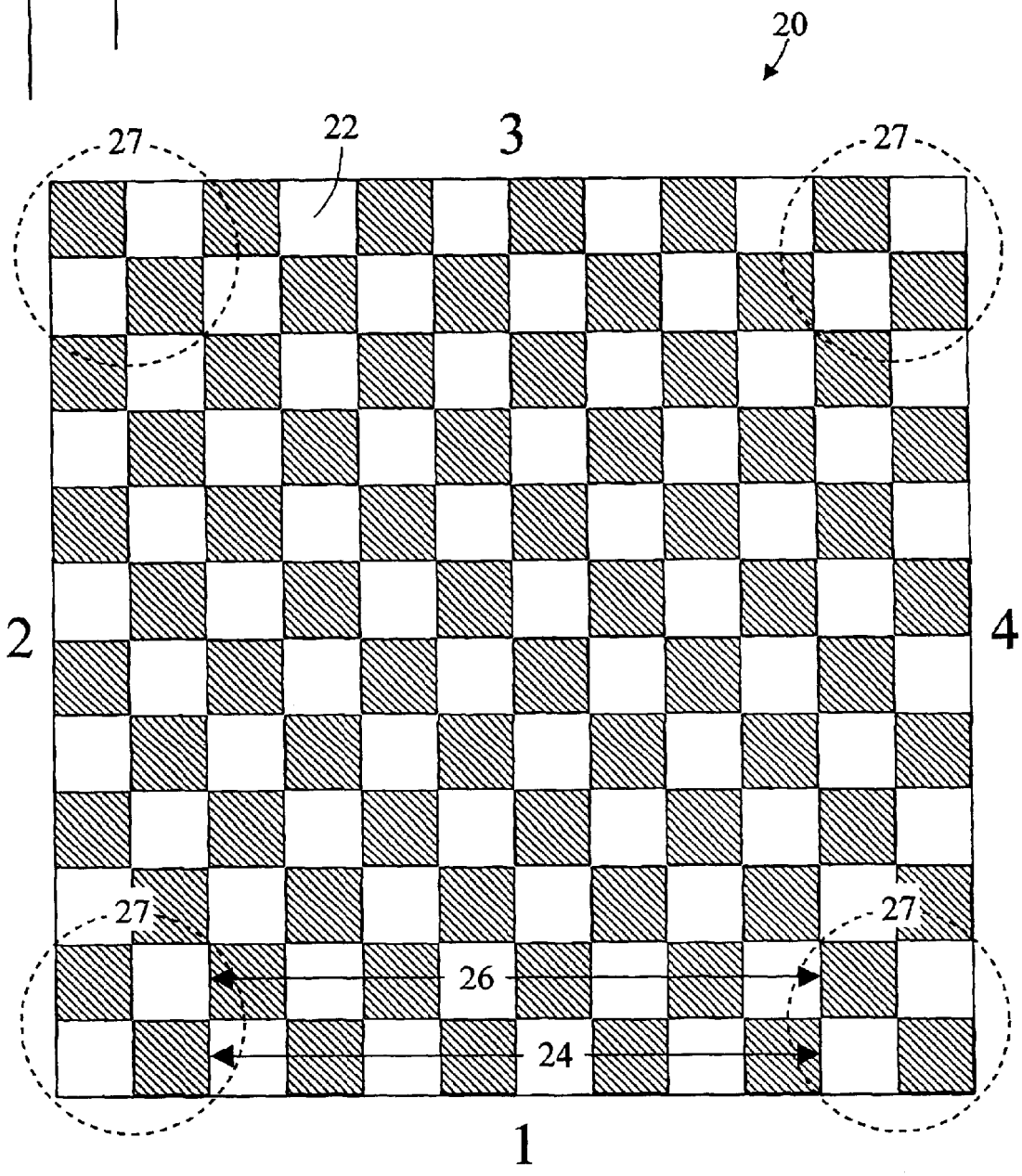
FIG. 1. shows a playing area for playing a modified game of chess in accordance with the present invention.

Referring initially to FIG. 1, there is illustrated a playing area for playing a modified game of chess in accordance with the present invention, generally designated as 20. Playing area 20 has 144 playing stations 22 arranged in a 12 by 12 matrix, the playing stations 22 being of two alternating types, and the playing area 20 having four sides (labeled 1–4), each side having (1) 12 playing stations 22 eight of which are middle playing stations 24 wherein two playing stations 22 are disposed on either side of the eight middle playing stations 24, and (2) eight inner playing stations 26 disposed in inward abutting relationship with the eight middle playing stations 24.

In a preferred embodiment, the alternating types of playing stations 22 comprise playing stations 22 of different colors so as to form a "checkerboard" arrangement, so that no two stations of the same color reside in side-by-side abutting relationship. It may be appreciated however, that other differentiating markings could be utilized to distinguish between the two types of playing stations 22. In the shown preferred embodiment, playing area 20 is square, however other shapes could also be employed.

It is noted that playing area 20 has four corner groups 27 of playing stations 22, each corner group 27 having four playing stations 22 arranged in a square configuration. As will be discussed later, in some playing embodiments chess pieces are not allowed to occupy the four corner groups 27.

Figure 2:
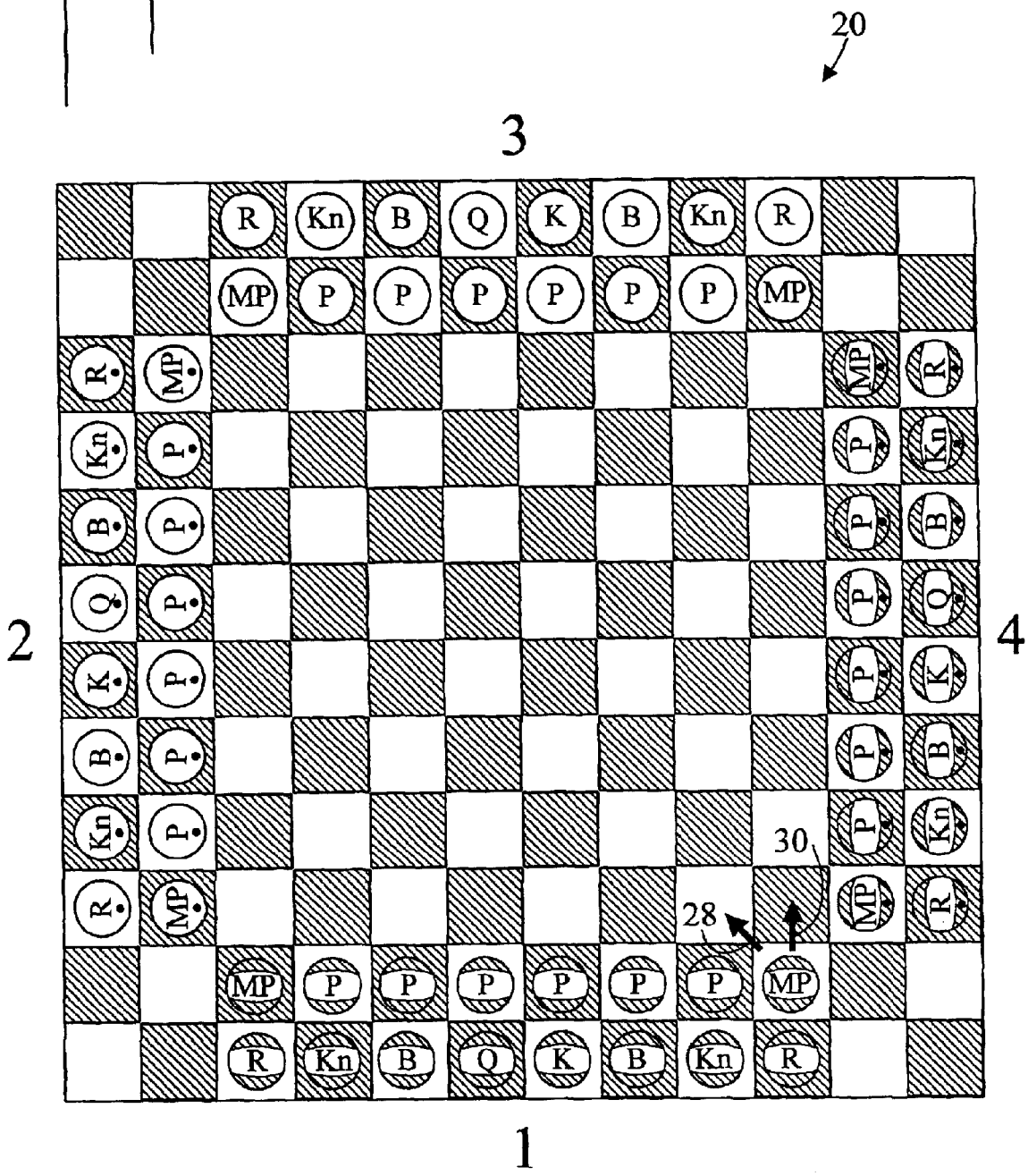
FIG. 2 shows four sets of chess pieces placed upon the playing area.

FIG. 2 shows four sets of chess pieces placed upon playing area 20. Each set of chess pieces includes eight pawns P, two rooks R, two knights Kn, two bishops B, a queen Q, and a king K. The chess pieces are placed in conventional starting arrangement upon the eight middle playing stations 24 and the eight inner playing stations 26 of each side of playing area 20 (refer to FIG. 1). The four sets of chess pieces each having a distinguishing characteristic, such as color, so that they may be clearly distinguished from one another. In the shown embodiment, one set of chess pieces is white (side 3), one is dark (side 1), one set is white with a dot (side 2), and one set is dark with a dot (side 4).

In a playing variation of the present invention, each set of chess pieces may optionally include at least one master pawn MP. The master pawn MP moves opposite to a conventional pawn. The master pawn MP moves diagonally 28 to advance, and moves straight ahead 30 to capture another piece. Prior to play, the players agree upon how many, if any, master pawns MP will be utilized during play of the game. In the shown embodiment, each player has two master pawns MP Four players, designated as 1–4, are disposed around playing area 20 wherein one player is disposed adjacent to each side 1–4 of playing area 20. The set of chess pieces disposed on a particular side of playing area 20 belong to the player who is also disposed on that particular side.

Method of Playing a Four Player Game:

In this embodiment of the present invention, four players play against each other, or teams of two players each play against each other. Refer to FIGS. 2–5 in the following discussion.

A method of playing a modified game of chess, includes:

(1) providing a playing area 20, the playing area having 144 playing stations 22 arranged in a 12 by 12 matrix, the playing stations 22 being of two alternating types, the playing area 20 having four sides, each side having (1) 12 playing stations 22 eight of which are middle playing stations 24 wherein two playing stations 22 are disposed on either side of the eight middle playing stations 24, and (2) eight inner playing stations 26 disposed in inward abutting relationship with the eight middle playing stations 24;

(2) providing four sets of chess pieces, each set of chess pieces being distinguishable from every other said set of chess pieces (such as by color);

(3) placing one set of chess piece in conventional starting arrangement upon the eight middle playing stations 24 and the eight inner playing stations 26 of each side of playing area 20;

(4) providing four players, one player disposed adjacent to each side of playing area 20, wherein the set of chess pieces disposed on a particular side of playing area 20 belong to the player who is also disposed on that particular side;

(5) providing rules of play, the rules of play including:

conventional rules of chess play;

additional rules of play which modify the conventional rules of chess play, the additional rules of play including:

the four players sequentially taking turns moving their chess pieces; and, (6) the four players playing a modified game of chess in accordance with the rules of play.

Conventional rules of chess play include those rules accepted by the United States Chess Federation, and any modifications thereto which are generally accepted by the chess-playing community. The four players sequentially taking turns moving their chess pieces, usually means moving one piece at a time, however two pieces can be moved during castling. Also, in a preferred embodiment the players take turns in sequential clockwise order.

The method can further include:

in step (5), the additional rules of play also including:

putting a king K into checkmate by one of (1) the pieces of two other players, and (2) by the pieces of three other players.

In conventional play, a player's king K s placed in checkmate by one or more pieces of the opposing player. In the present invention having four players, a player's king K may also be placed in checkmate by the pieces of two other players, or even the pieces of three other players.

The method can further include:

in step (5), the additional rules of play also including:

(1) when a king K is checkmated, the player whose king K is checkmated removing all his or her chess pieces from playing area 20 and retiring from play, or alternatively, (2) when a king K is checkmated, the player whose king K is checkmated removing his or her king K from the playing area 20, leaving all remaining chess pieces in place on playing area 20, and retiring from play.

Figure 3:
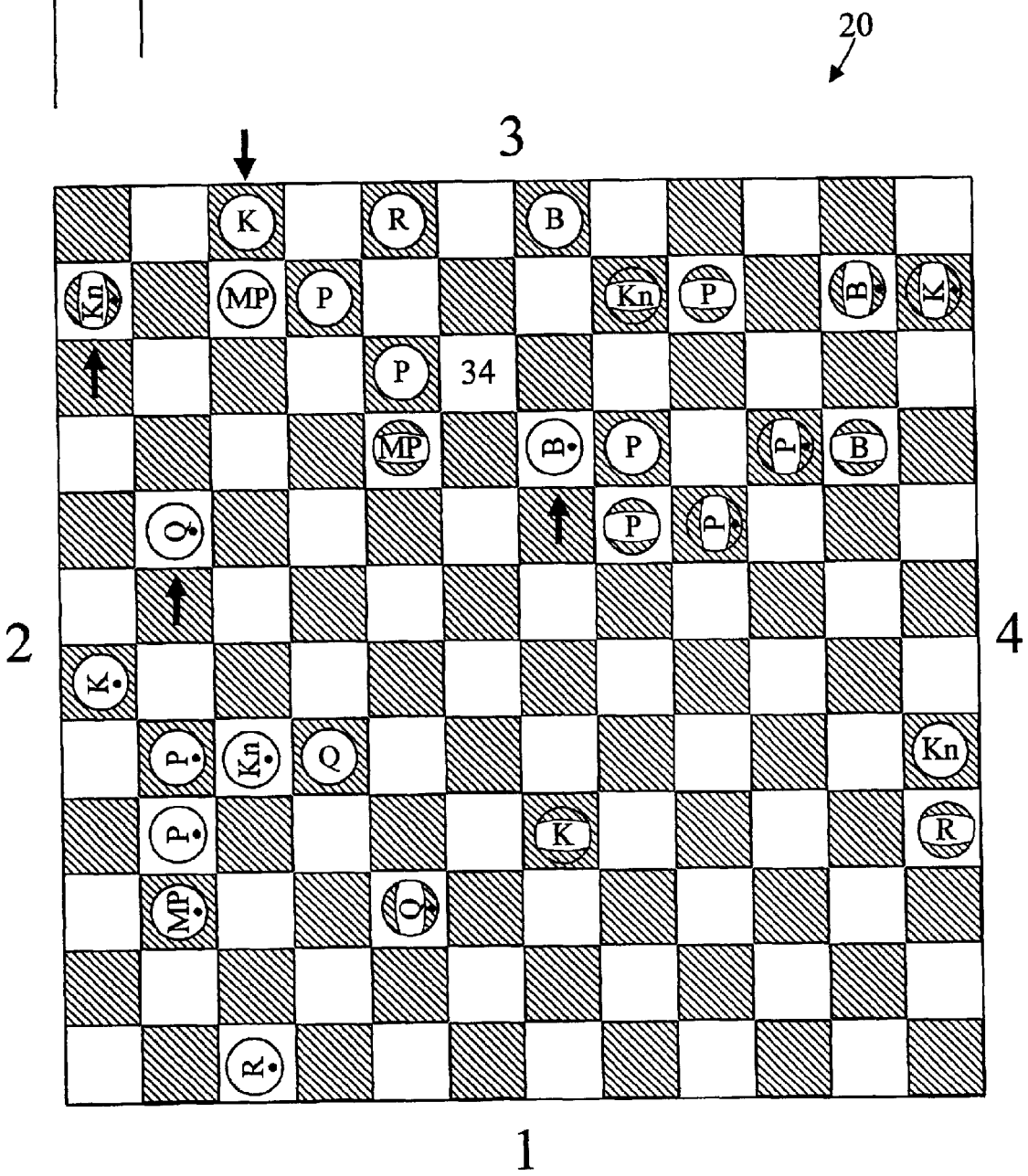
FIG. 3 shows the position of the sets of chess pieces after a period of play.
Figure 4:
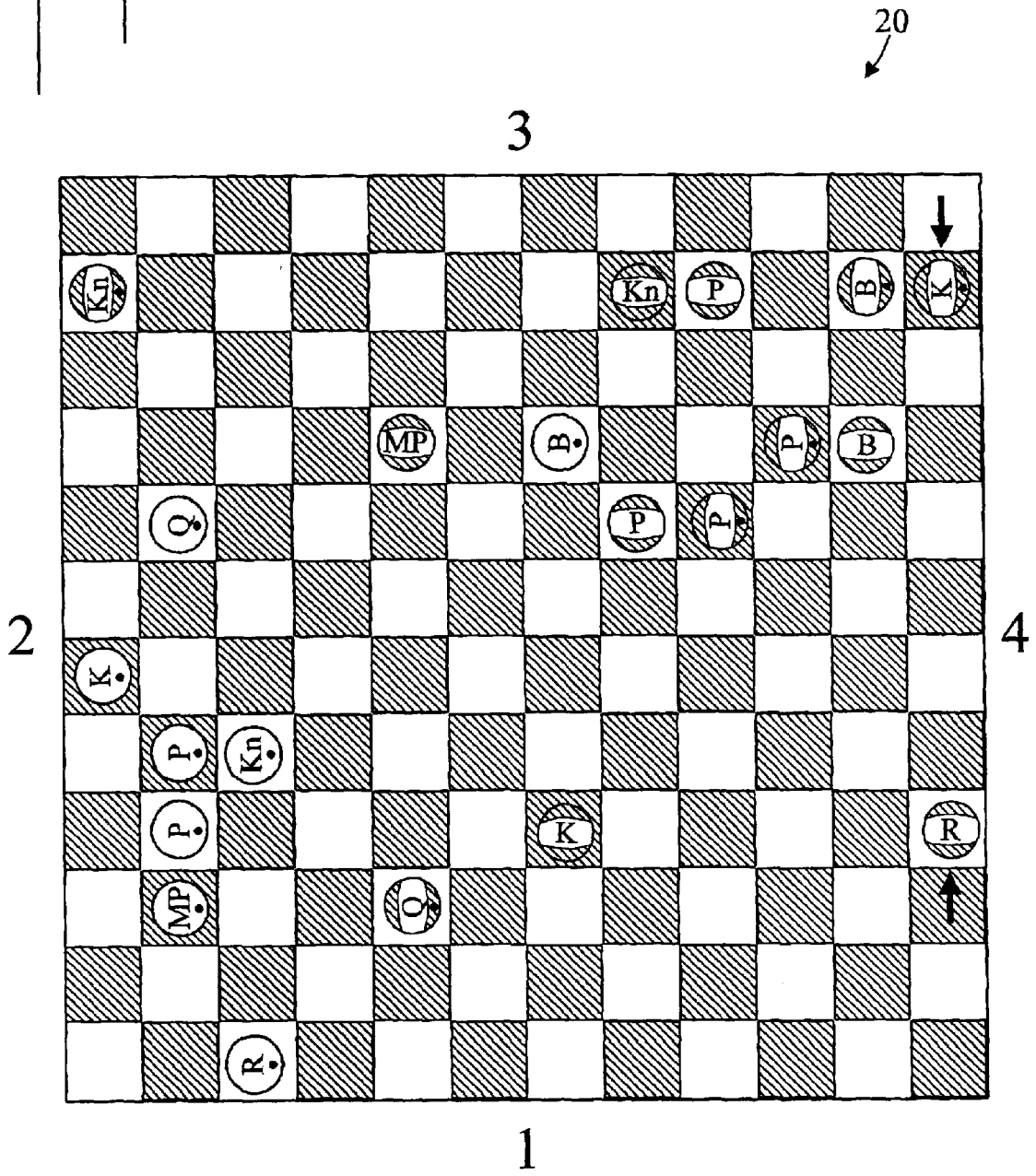
FIG. 4 shows the pieces of FIG. 3 after all the chess pieces of a checkmated player have been removed from the playing area.
Figure 5:
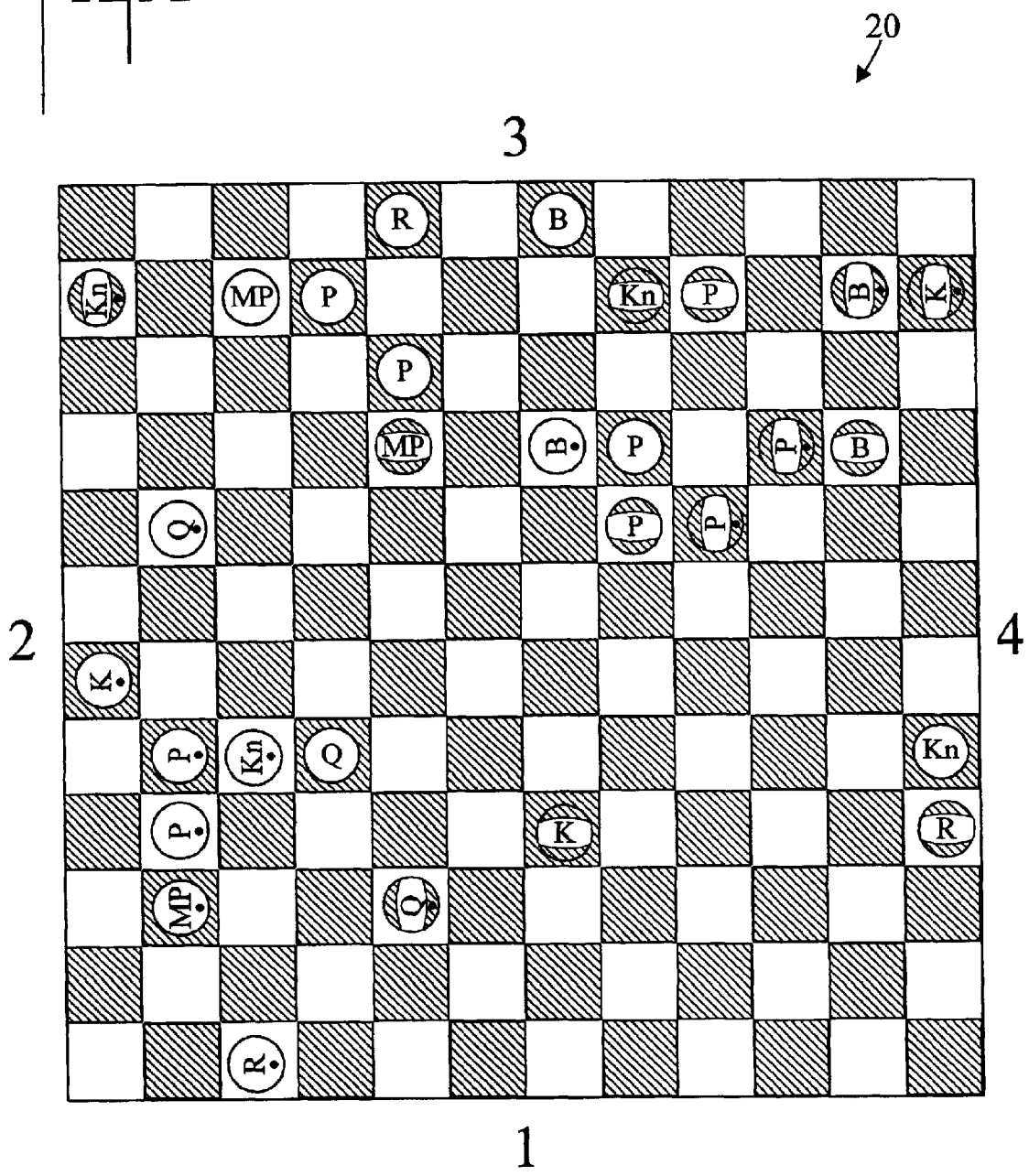
FIG. 5 shows the pieces of FIG. 3 after only the king of a checkmated player have been removed from the playing area.

Referring to FIG. 3, there is illustrated the position of the sets of chess pieces after a period of play. The king K of player 3 has been checkmated by the knight Kn of player to 2, the queen Q of player 4, and the bishop B of player number 4. In one playing embodiment, all of the checkmated players chess pieces are removed from the playing area 20 (refer to FIG. 4). By suddenly removing all of a player's chess pieces some interesting developments may occur. For example, in FIG. 4 it is noted that with player 3's chess pieces removed, player 4's king K is suddenly place in check by player 1's rook R. FIG. 5 shows a less volatile playing embodiment wherein only the king K of checkmated player 3 is removed from playing area 20, and all other chess pieces of player 3 remain in place. These piece cannot move, but can be captured by other players.

The method can further include:

in step (5), the additional rules of play including:

when a king K is checkmated, the checkmate removable by an intervening player.

Still referring to FIG. 3, in another optional playing embodiment, a checkmate may be removed by an intervening player. This option is particularly useful in team play where two players are playing against the other two players. After the knight Kn of player 2 places the king K of player 3 in checkmate, player 1 may remove the checkmate by moving either a master pawn MP or knight Kn to the square designated by 34. This takes player 3 out of checkmate, so that when it becomes player 3's sequential turn, he or she will no longer be in checkmate and can continue to play by moving out of check.

The method can further include:

in step (2), each set of chess pieces including at least one master pawn MP; and in step (5), the additional rules of play including the master pawn MP moving diagonally and capturing straight ahead.

The method can further include:

in step (1), playing area 20 having four corner groups 27 of playing stations 22, each corner group 27 having four playing stations 22 arranged in a square configuration;

in step (5), the additional rules of play including one of:

(a) during play chess pieces not allowed to occupy the playing stations 22 of the four corner groups 27; and, (b) during play chess pieces initially not allowed to occupy the playing stations 22 of the four corner groups 27, but upon the occurrence of a predetermined event, chess pieces being allowed to occupy playing stations 22 of the four corner groups 27.

For example, in one embodiment, chess pieces cannot occupy the playing stations 22 of the four corner groups 27 until the first player is checkmated and retires from play. After that event, chess pieces can occupy the playing stations 22 of the four corner groups 27.

Method of Playing a Three Player Game with a Phantom Player:

In this embodiment of the present invention, three players play against each other. The fourth set of chess pieces are designated as common pieces of a "phantom" player. Each of the three players take turns moving the common pieces. Refer to FIGS. 2–5 in the following discussion.

A method of playing a modified game of chess includes:

(1) providing a playing area 20, the playing area having 144 playing stations 22 arranged in a 12 by 12 matrix, the playing stations 22 being of two alternating types, the playing area 20 having four sides, each side having (1) 12 playing stations 22 eight of which are middle playing stations 24 wherein two playing stations 22 are disposed on either side of the eight middle playing stations 24, and (2) eight inner playing stations 26 disposed in inward abutting relationship with the eight middle playing stations 24;

(2) providing four sets of chess pieces, each set of chess pieces being distinguishable from every other said set of chess pieces (such as by color);

(3) placing one set of said chess piece in conventional starting arrangement upon the eight middle playing stations 24 and the eight inner playing stations 26 of each side of playing area 20;

(4) providing three players, one player disposed adjacent to each of three sides of playing area 20, wherein the set of chess pieces disposed on a particular side of playing area 20 belong to the player who is also disposed on that particular side;

(5) providing rules of play, the rules of play including:

conventional rules of chess play;

additional rules of play which modify the conventional rules of chess play, the additional rules of play including:

designating the set of chess pieces disposed on a fourth side of playing area 20 as common pieces which may be moved by any of the three players;

the three players and the common pieces sequentially taking turns moving;

when it is the common pieces turn to move, the three players sequentially taking turns moving the common pieces; and, (6) the three players playing a modified game of chess in accordance with the rules of play.

The method can further include:

in step (5), the additional rules of play including:

putting a king K into checkmate by one of (1) the pieces of two other players, and (2), the pieces of two other players and the common pieces.

The method can further include:

in step (5), the additional rules of play including:

(1) when a king K is checkmated, the player whose king K is checkmated removing all his or her chess pieces from playing area 20 and retiring from play, or alternatively, (2) when a king K is checkmated, the player whose king K is checkmated removing his or her king K from the playing area 20, leaving all remaining chess pieces in place on playing area 20, and retiring from play.

The method can further include:

in step (5), the additional rules of play including:

when a king K is checkmated, the checkmate removable by an intervening player.

The method can further include:

in step (2), each set of chess pieces including at least one master pawn MP; and in step (5), the additional rules of play including the master pawn MP moving diagonally and capturing straight ahead.

The method can further include:

in step (1), playing area 20 having four corner groups 27 of playing stations 27, each corner group 27 having four playing stations 22 arranged in a square configuration;

in step (5), the additional rules of play including one of:

(a) during play chess pieces not allowed to occupy the playing stations 22 of the four corner groups 27; and, (b) during play chess pieces initially not allowed to occupy the playing stations 22 of the four corner groups 27, but upon the occurrence of a predetermined event, chess pieces being allowed to occupy playing stations 22 of the four corner groups 27.

In another possible embodiment, the players utilize a chip or other marker to keep track of who's turn it is to move the common pieces. In another possible embodiment, the common pieces can be checkmated, and then all the common pieces 20 removed from playing area, or just the king K of the common pieces removed with the remaining common pieces left in place on playing area 20.

Figure 6:
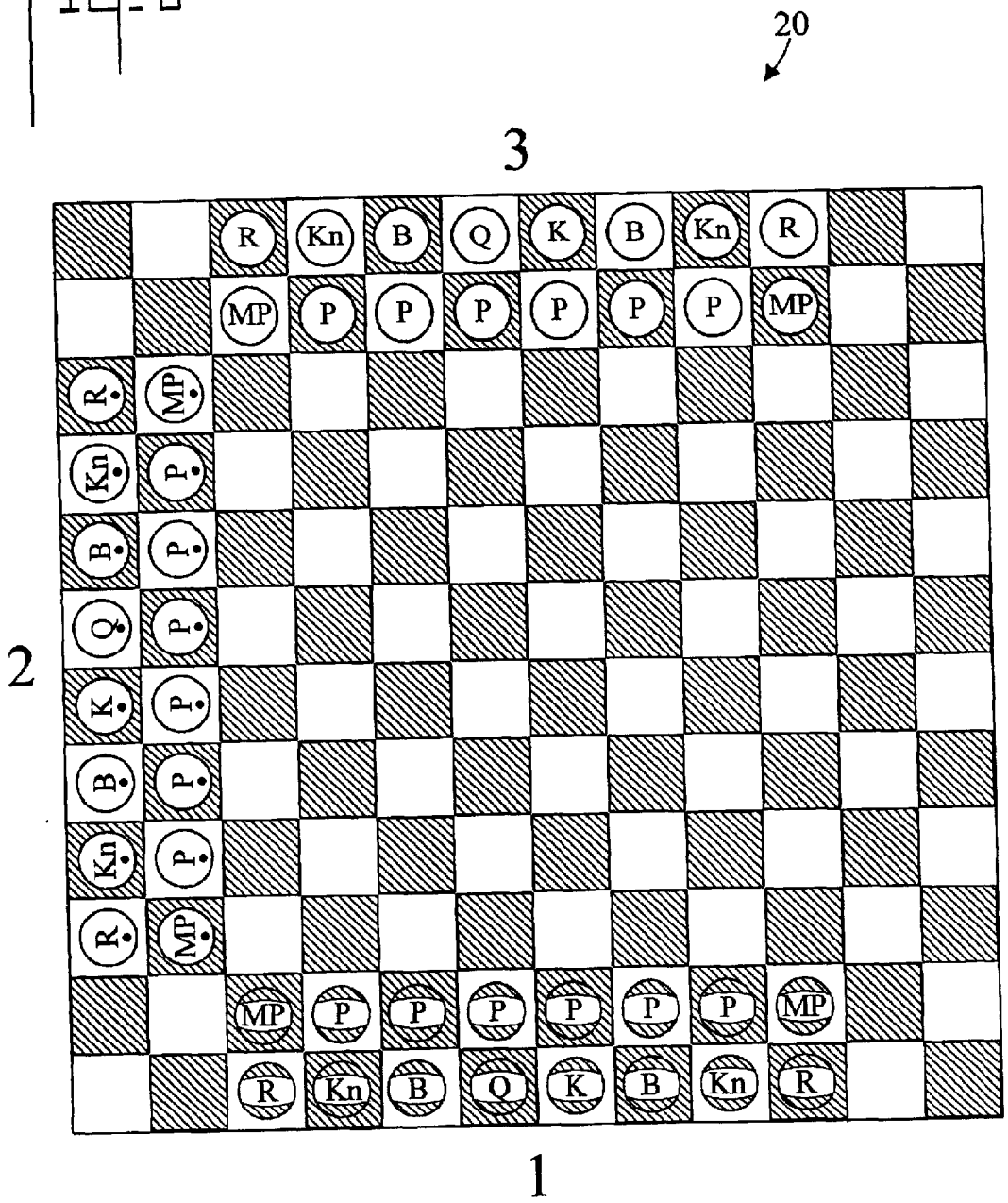
FIG. 6 shows a three player embodiment of the present invention.

Method of Playing a Three Player Game without a Phantom Player:

In this embodiment of the present invention, three players play against each other. Only three sets of chess pieces are placed upon the playing area 20. Refer to FIG. 6.

A method of playing a modified game of chess includes:

(1) providing a playing area 20, the playing area having 144 playing stations 22 arranged in a 12 by 12 matrix, the playing stations 22 being of two alternating types, the playing area 20 having four sides, each side having (1) 12 playing stations 22 eight of which are middle playing stations 24 wherein two playing stations 22 are disposed on either side of the eight middle playing stations 24, and (2) eight inner playing stations 26 disposed in inward abutting relationship with the eight middle playing stations 24;

(2) providing three sets of chess pieces, each set of chess pieces being distinguishable from every other said set of chess pieces (such as by color);

(3) placing one set of chess piece in conventional starting arrangement upon the eight middle playing stations 24 and the eight inner playing stations 26 of three sides of playing area 20;

(4) providing three players, one player disposed adjacent to each of three sides of playing area 20, wherein the set of chess pieces disposed on a particular side of playing area 20 belong to the player who is also disposed on that particular side;

(5) providing rules of play, the rules of play including:

conventional rules of chess play;

additional rules of play which modify the conventional rules of chess play, the additional rules of play including:

the three players sequentially taking turns moving their chess pieces; and, (6) the three players playing a modified game of chess in accordance with the rules of play.

The method can further include:

in step (5), the additional rules of play including:

putting a king K into checkmate by the pieces of two other players.

The method can further include:

in step (5), the additional rules of play including:

(1) when a king K is checkmated, the player whose king K is checkmated removing all his or her chess pieces from playing area 20 and retiring from play, or alternatively, (2) when a king K is checkmated, the player whose king K is checkmated removing his or her king K from the playing area 20, leaving all remaining chess pieces in place on playing area 20, and retiring from play.

The method can further include:

in step (5), the additional rules of play including:

when a king K is checkmated, the checkmate removable by an intervening player.

The method can further include:

in step (2), each set of chess pieces including at least one master pawn MP; and in step (5), the additional rules of play including the master pawn MP moving diagonally and capturing straight ahead.

The method can further include:

in step (1), playing area 20 having four corner groups 27 of playing stations 27, each corner group 27 having four playing stations 22 arranged in a square configuration;

in step (5), the additional rules of play including one of:

(a) during play chess pieces not allowed to occupy the playing stations 22 of the four corner groups 27; and, (b) during play chess pieces initially not allowed to occupy the playing stations 22 of the four corner groups 27, but upon the occurrence of a predetermined event, chess pieces being allowed to occupy playing stations 22 of the four corner groups 27.

Method of Playing a Two Player Game with two Phantom Players:

In this embodiment of the present invention, two players play against each other using four set of chess pieces. Two sets of chess pieces are designated common pieces.

The two players take turns moving the common pieces. Refer to FIGS. 2–5 in the following discussion.

A method of playing a modified game of chess, includes:

(1) providing a playing area 20, the playing area having 144 playing stations 22 arranged in a 12 by 12 matrix, the playing stations 22 being of two alternating types, the playing area 20 having four sides, each side having (1) 12 playing stations 22 eight of which are middle playing stations 24 wherein two playing stations 22 are disposed on either side of the eight middle playing stations 24, and (2) eight inner playing stations 26 disposed in inward abutting relationship with the eight middle playing stations 24;

(2) providing four sets of chess pieces, each set of chess pieces being distinguishable from every other said set of chess pieces (such as by color);

(3) placing one set of chess piece in conventional starting arrangement upon the eight middle playing stations 24 and the eight inner playing stations 26 of each side of playing area 20;

(4) providing two players, one player disposed adjacent to each of two sides of playing area 20, wherein one set of chess pieces belong to each player;

(5) providing rules of play, the rules of play including:

conventional rules of chess play;

additional rules of play which modify the conventional rules of chess play, the additional rules of play including:

designating the sets of chess pieces disposed on two unoccupied sides of playing area 20 as common pieces which may be moved by both of the two players;

the two players and the two common pieces sequentially taking turns moving;

when it is each of the common pieces turn to move, the two players sequentially taking turns moving the common pieces; and, (6) the two players playing a modified game of chess in accordance with the rules of play.

It is noted that if the two players sit across from each other, one player will always move one common set of chess pieces and the other player will always move the other common set of chess pieces. For example, if the players occupy sides 1 and 3, the moving sequence would be, player 1 moving, player 3 moving one of the common pieces of side 2, player 3 moving, player 1 moving one of the common pieces of side 4, player 1 moving, player 3 moving one of the common pieces of side 2, etc.

The method can further include:

in step (5), the additional rules of play including putting a king K into checkmate by one of (1) the pieces of the other player and one set of common pieces, (2) the pieces of both sets of common pieces, and (3) the pieces of the other player, and both sets of common pieces.

The method can further include:

in step (2), each set of chess pieces including at least one master pawn MP; and in step (5), the additional rules of play including the master pawn MP moving diagonally and capturing straight ahead.

The method can further include:

in step (1), playing area 20 having four corner groups 27 of playing stations 27, each corner group 27 having four playing stations 22 arranged in a square configuration;

in step (5), the additional rules of play including one of:

(a) during play chess pieces not allowed to occupy the playing stations 22 of the four corner groups 27; and, (b) during play chess pieces initially not allowed to occupy the playing stations 22 of the four corner groups 27, but upon the occurrence of a predetermined event, chess pieces being allowed to occupy playing stations 22 of the four corner groups 27.

Figure 7:
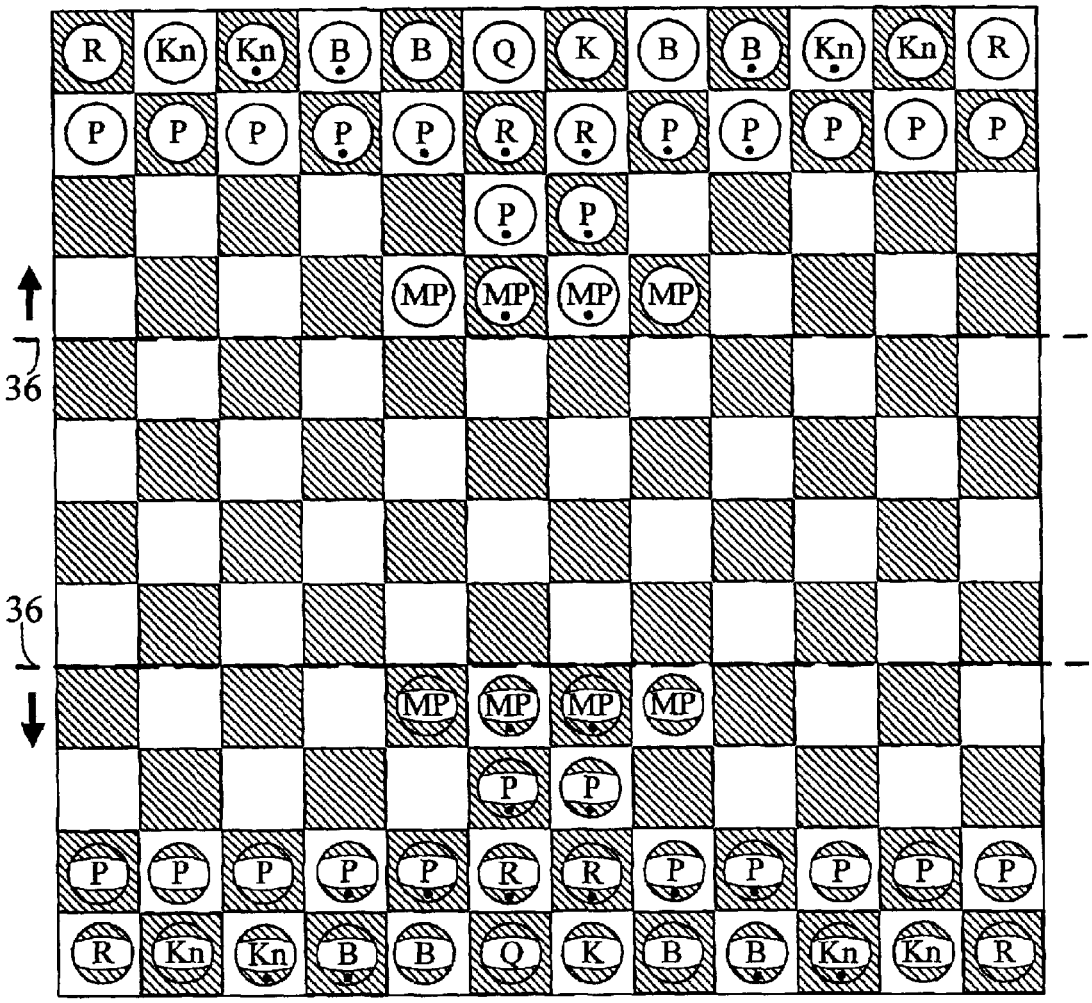
FIG. 7 shows a two player embodiment wherein the players have additional chess pieces, but only have one king and one queen.

Method of Playing a Two Player Game with Additional Chess Pieces, but with Only One King and One Queen In this embodiment of the present invention two players play against each other. Each player has two sets of chess pieces, except that each player only has one king K and one queen Q. Refer to FIG. 7 in the following discussion.

A method of playing modified game of chess includes:

(1) providing a playing area 20, the playing area 20 having 144 playing stations 22 arranged in a 12 by 12 matrix, the playing stations 22 being of two alternating types, playing area 20 having four sides, each side having 12 playing stations 22;

(2) providing two sets of chess pieces distinguishable from each other, each set of chess pieces including:

16 pawns P;

four rooks R;

four knights Kn;

four bishops B;

one king K; and, one queen Q;

(3) providing two players, one player disposed adjacent to one side of playing area 20, and another player disposed adjacent to another side of playing area 20, one set of chess pieces belonging to one player and the another set of chess pieces belonging to the other said player;

(4) the two players placing their chess pieces upon playing area 20;

(5) providing rules of play, the rules of play including:

conventional rules of chess play; and (6) the two players playing a modified game of chess in accordance with the rules of play.

In FIG. 7 the players have positioned their chess pieces as shown. It may be appreciated that other placements could also be made.

The method can further include:

in step (4), the placing of the chess pieces limited to designated portions of playing area 20.

For example, the designated portions might include any playing stations 22 located behind line 36.

The method can further include:

in step (2), each set of chess pieces including at least one master pawn MP; and in step (5), additional rules of play modifying the conventional rules of play, the additional rules of play including the master pawn MP moving diagonally and capturing straight ahead.

The method can further include:

in step (1), playing area 20 having four corner groups 27 of playing stations 27, each corner group 27 having four playing stations 22 arranged in a square configuration;

in step (5), additional rules of play modifying the conventional rules of play, the additional rules of play including one of:

(a) during play chess pieces not allowed to occupy the playing stations 22 of the four corner groups 27; and, (b) during play chess pieces initially not allowed to occupy the playing stations 22 of the four corner groups 27, but upon the occurrence of a predetermined event, chess pieces being allowed to occupy playing stations 22 of the four corner groups 27.

Figure 8:
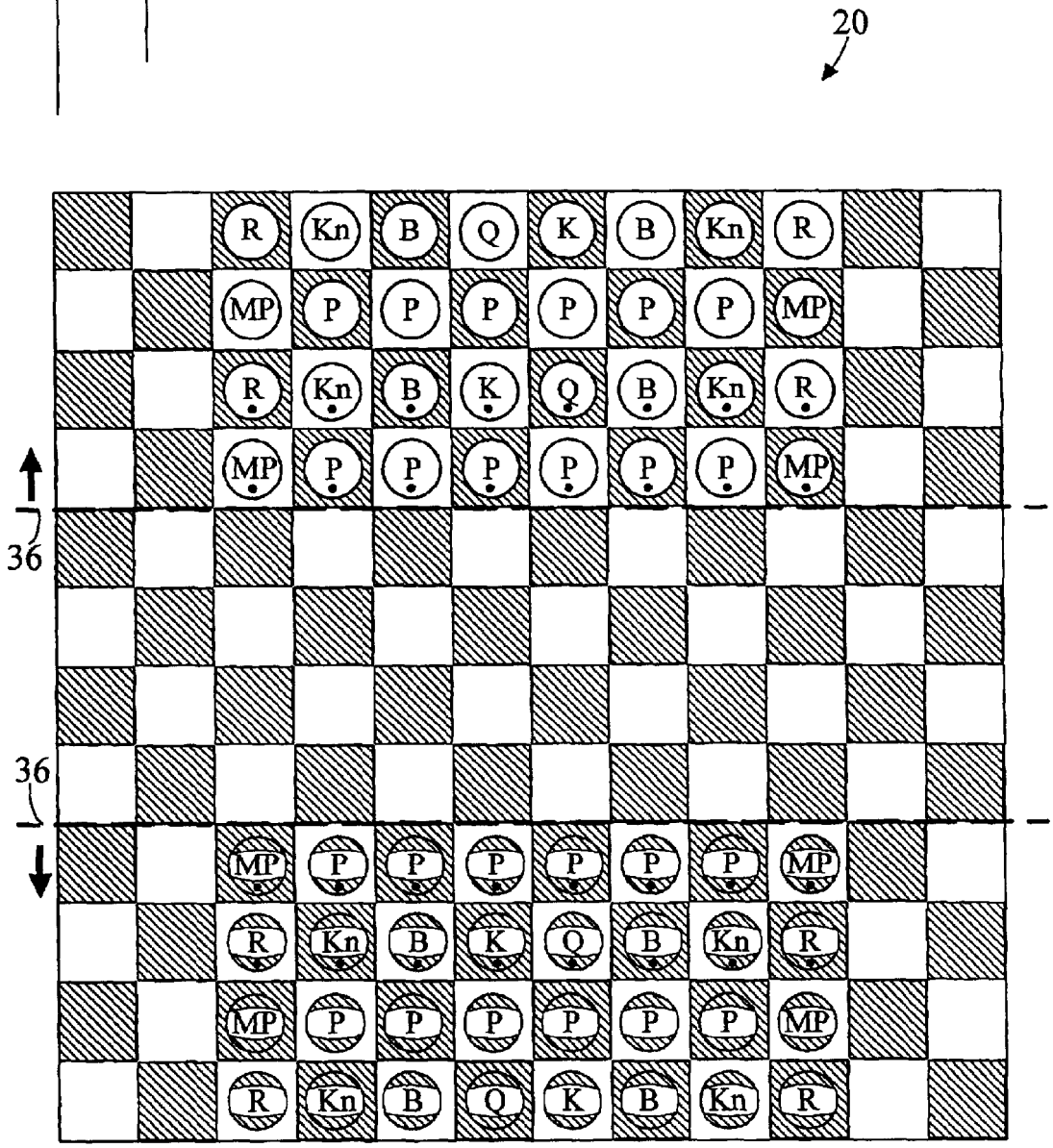
FIG. 8 shows a two player embodiment wherein each player has two complete sets of chess pieces.

Method of Playing a Two Player Game Where Each Player has Two Complete Sets of Chess Pieces:

In this embodiment of the present invention two players play against each other. Each player has two complete sets of chess pieces, including two kings K and two queens Q. Refer to FIG. 8 in the following discussion.

A method of playing a modified game of chess, including:

(1) providing a playing area 20, the playing area 20 having 144 playing stations 22 arranged in a 12 by 12 matrix, the playing stations 22 being of two alternating types, the playing area having four sides, each side having 12 playing stations 22;

(2) providing four sets of chess pieces, each set of chess pieces being distinguishable from every other set of chess pieces (such as by color);

(3) providing two players, one player disposed adjacent to one side of playing area 20, and another player disposed adjacent to another side of playing area 20, two sets of chess pieces belonging to one player and the other two sets of chess pieces belonging to the other said player;

(4) the two players placing their chess pieces upon playing area 20;

(5) providing rules of play, the rules of play including:

conventional rules of chess play; and, additional rules of play which modify the conventional rules of chess play, the additional rules of play including;

the game ending when both of a player's kings K have been checkmated; and, (6) said two players playing a modified game of chess in accordance with said rules of play.

In FIG. 8 the players have positioned their chess pieces as shown. It may be appreciated that other placements could also be made.

The method can further include:

in step (4), the placing of the chess pieces limited to designated portions of playing area 20.

The method can further including:

in step (5), said additional rules of play including:

(1) when a king K is checkmated, the player whose king K is checkmated removing all his or her chess pieces of the same color from playing area 20, or alternatively, (2) when a king K is checkmated, the player whose king is checkmated removing the checkmated king K from playing area 20, an leaving all remaining chess pieces of the same color as the checkmated king K in place on the playing area.

The method can further include:

in step (5), said additional rules of play including:

when the checkmated king is removed from playing area 20, the removal counted as a move by the player.

The method can further include:

in step (2), each set of chess pieces including at least one master pawn MP; and in step (5), additional rules of play modifying the conventional rules of play, the additional rules of play including the master pawn MP moving diagonally and capturing straight ahead.

The method can further include:

in step (1), playing area 20 having four corner groups 27 of playing stations 27, each corner group 27 having four playing stations 22 arranged in a square configuration;

in step (5), additional rules of play modifying the conventional rules of play, the additional rules of play including one of:

(a) during play chess pieces not allowed to occupy the playing stations 22 of the four corner groups 27; and, (b) during play chess pieces initially not allowed to occupy the playing stations 22 of the four corner groups 27, but upon the occurrence of a predetermined event, chess pieces being allowed to occupy playing stations 22 of the four corner groups 27.

Figure 9:
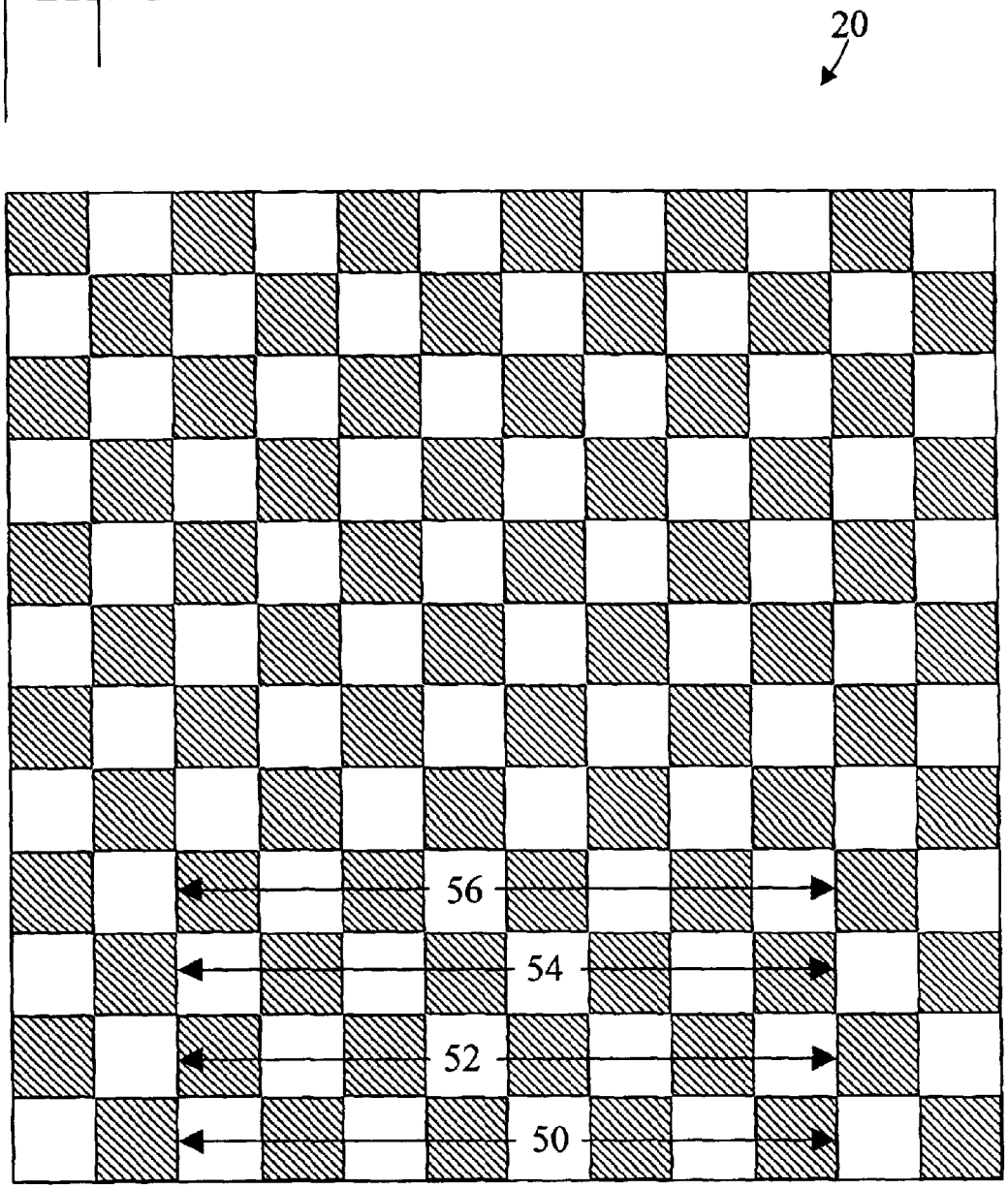
FIG. 9 shows a playing area for playing a modified game of chess wherein all of the chess pieces are moved forward two rows; and, FIG. 10 shows two sets of chess pieces in starting position moved forward two rows.
Figure 10:
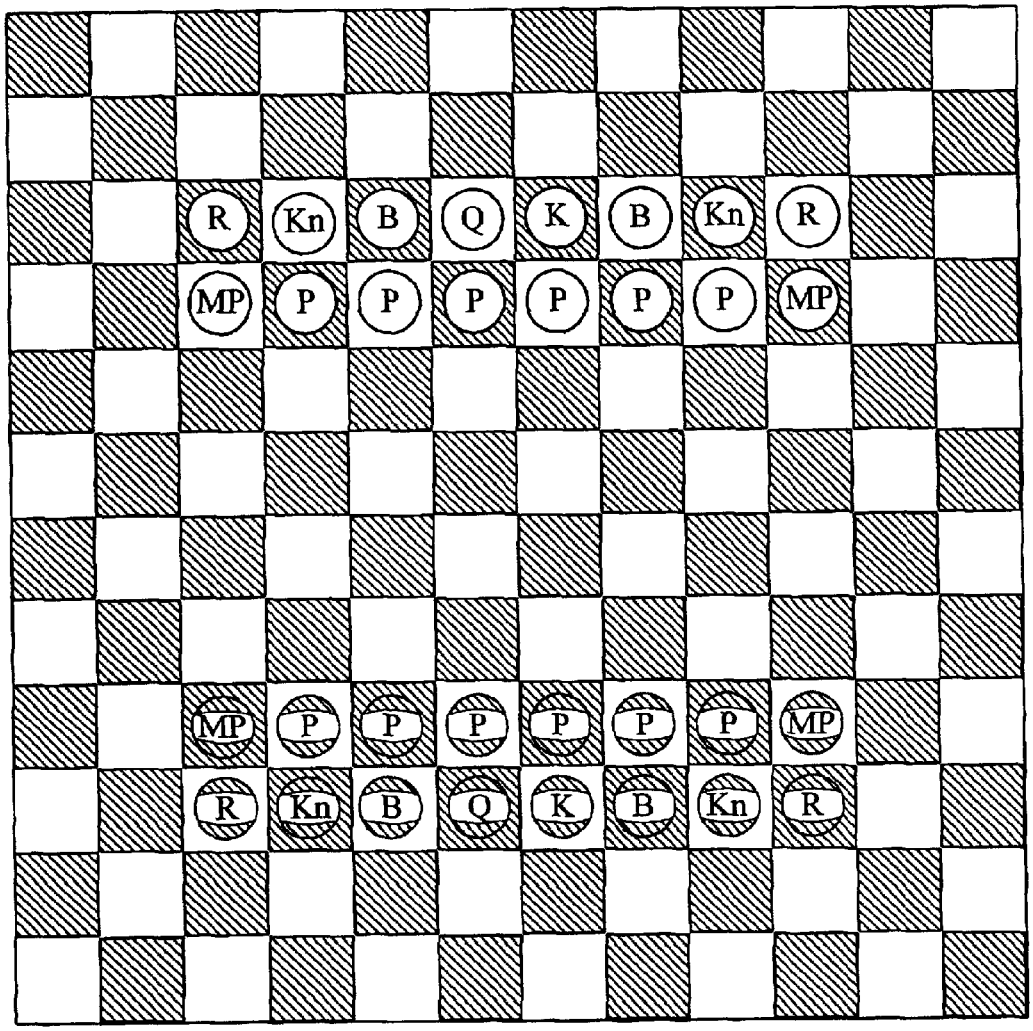

Method of Playing a Two Player Game Wherein All Chess Pieces are Moved Forward Two Rows:

In this embodiment of the present invention, two players play against each other. The starting position of all the chess pieces of the players is moved forward two rows, leaving two empty rows behind the chess pieces. Refer to FIGS. 9 and 10 for the following discussion.

A method of playing a modified game of chess includes:

(1) providing a playing area 20, the playing area 20 having 144 playing stations 22 arranged in a 12 by 12 matrix, the playing stations 22 being of two alternating types, the playing area 20 having four sides, each side having 12 playing stations 22 eight of which are middle playing stations 24 wherein two playing stations 22 are disposed on either side of the eight middle playing stations 50, each side further having (1) eight first tier playing stations 52 disposed in inward abutting relationship with the eight middle playing stations 50, (2) eight second tier playing stations 54 disposed in inward abutting relationship with the eight first tier playing stations 52, and (3) eight third tier playing stations 56 disposed in inward abutting relationship with the eight second tier playing stations 54;

(2) providing two sets of chess pieces distinguishable from each other;

(3) placing one set of chess piece in conventional starting arrangement upon eight second tier playing stations 54 and the eight third tier playing stations 56 of two opposite sides of playing area 20, so that the middle playing stations 50 and the first tier playing stations 52 are disposed behind the sets of chess pieces;

(4) providing two players, disposed adjacent to the two sets of chess pieces; and, (5) the two players playing a modified game of chess.

The method can further include:

in step (2), each set of chess pieces including at least one master pawn MP; and, the master pawn MP moving diagonally and capturing straight ahead.

The method can further include:

in step (1), playing area 20 having four corner groups 27 of playing stations 22, each corner group 27 having four playing stations 22 arranged in a square configuration;

in step (5), one of:

(a) during play chess pieces not allowed to occupy the playing stations 22 of the four corner groups 27; and, (b) during play the chess pieces initially not allowed to occupy playing stations 22 of the four corner groups 27, but upon the occurrence of a predetermined event, the chess pieces being allowed to occupy the playing stations 22 of the four corner groups 27.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A method for four players to play a modified game of chess, comprising:

(1) providing a playing area, said playing area having 144 playing stations arranged in a 12 by 12 matrix, said playing stations being of two alternating types, said playing are a having four sides, each said side having (1) 12 said playing stations eight of which are middle playing stations wherein two said playing stations are disposed on either side of said eight middle playing stations, and (2) eight inner playing stations disposed in inward abutting relationship with said eight middle playing stations;

(2) providing four sets of chess pieces;

(3) placing one said set of chess piece in conventional starting arrangement upon said eight middle playing stations and said eight inner playing stations of each said side of said playing area;

(4) one said player disposed adjacent to each said side of said playing area, wherein said set of chess pieces disposed on a particular side of said playing area belong to said player who is also disposed on said particular side;

(5) providing rules of play, said rule of play including:
conventional rules of chess play;
additional rules of play which modify said conventional rules of chess play, said additional rules of play including:
said four players sequentially taking turns moving their said chess pieces;

(6) said four players playing a modified game of chess in accordance with said rules of play;

in step (1), said playing area having four corner groups of said playing stations, each said corner group having four said playing stations arranged in a square configuration;

in step (5), said additional rules of play including one of:

(a) during play said chess pieces not allowed to occupy said playing stations of said four corner groups; and, (b) during play said chess pieces initially not allowed to occupy said playing stations of said four corner groups, but upon the occurrence of a predetermined event, said chess pieces being allowed to occupy said playing stations of said four corner groups.

2. A method for three players to play a modified game of chess, comprising:

(1) providing a playing area, said playing area having 144 playing stations arranged in a 12 by 12 matrix, said playing stations being of two alternating types, said playing area having four sides, each said side having (1) 12 said playing stations eight of which are middle playing stations wherein two said playing stations are disposed on either side of said eight middle playing stations, and (2) eight inner playing stations disposed in inward abutting relationship with said eight middle playing stations;

(2) providing four sets of chess pieces;

(3) placing one said set of chess pieces in conventional starting arrangement upon said eight middle playing stations and said eight inner playing stations of each said side of said playing area;

(4) one said player disposed adjacent to each of three said sides of said playing area, wherein said set of chess pieces disposed on a particular side of said playing area belong to said player who is also disposed on said particular side;

(5) providing rules of play, said rules of play including:
conventional rules of chess play;
additional rules of play which modify said conventional rules of chess play, said additional rules of play including:
designating said set of chess pieces disposed on a fourth side of said playing area as common pieces which may be moved by any of said three players;
said three players and said common pieces sequentially taking turns moving;
when it is said common pieces turn to move, said three players sequentially taking turns moving said common pieces; and, (6) said three players playing a modified game of chess in accordance with said rules of play.

3. The method of claim 2, further including:

in step (5), said additional rules of play including:
putting a king into checkmate by one of (1) said pieces of two other said players, and (2) said pieces of two other said players and said common pieces.

4. The method of claim 2, further including:

in step (5), said additional rules of play including:
One of (1) when a king is checkmated, said player whose king is checkmated removing all his or her said chess pieces from said playing area and retiring from play, and (2) when a king is checkmated, said player whose king is checkmated removing his or her king from said playing area, leaving all remaining said chess pieces in place on said playing area, and retiring from play.

5. The method of claim 2, further including:

in step (5), said additional rules of play including:

when a king is checkmated, said checkmate removable by an intervening player.

6. The method of claim 2, further including:

in step (2), each said set of chess pieces including at least one master pawn; and, in step (5), said additional rules of play including said master pawn moving diagonally and capturing straight ahead.

7. The method of claim 2, further including:

in step (1), said playing area having four corner groups of said playing stations, each said corner group having four said playing stations arranged in a square configuration;

in step (5), said additional rules of play including one of:

(a) during play said chess pieces not allowed to occupy said playing stations of said four corner groups; and, (b) during play said chess pieces initially not allowed to occupy said playing stations of said four corner groups, but upon the occurrence of a predetermined event, said chess pieces being allowed to occupy said playing stations of said four corner groups.

8. A method for three players to play a modified game of chess, comprising:

(1) providing a playing area, said playing area having 144 playing stations arranged in a 12 by 12 matrix, said playing stations being of two alternating types, said playing area having four sides, each said side having (1) 12 said playing stations eight of which are middle playing stations wherein two said playing stations are disposed on either side of said eight middle playing stations, and (2) eight inner playing stations disposed in inward abutting relationship with said eight middle playing stations;

(2) providing three sets of chess pieces;

(3) placing one said set of chess pieces in conventional starting arrangement upon said eight middle playing stations and said eight inner playing stations of three said sides of said playing area;

(4) one said player disposed adjacent to each said three sides of said playing area, wherein said set of chess pieces disposed on a particular side of said playing area belong to said player who is also disposed on said particular side;

(5) providing rules of play, said rules of play including:

conventional rules of chess play;

additional rules of play which modify said conventional rules of chess play, said additional rules of play including:

said three players sequentially taking turns moving their said chess pieces;

(6) said three players playing a modified game of chess in accordance with said rules of play;

in step (1), said playing area having four corner groups of said playing stations, each said corner group having four said playing stations arranged in a square configuration;

in step (5), said additional rules of play including one of:

(a) during play said chess pieces not allowed to occupy said playing stations of said four corner groups; and, (b) during play said chess pieces initially not allowed to occupy said playing stations of said four corner groups, but upon the occurrence of a predetermined event, said chess pieces being allowed to occupy said playing stations of said four corner groups.

9. A method for two players to play a modified game of chess, comprising:

(1) providing a playing area, said playing area having 144 playing stations arranged in a 12 by 12 matrix, said playing stations being of two alternating types, said playing area having four sides, each said side having (1) 12 said playing stations eight of which are middle playing stations wherein two said playing stations are disposed on either side of said eight middle playing stations, and (2) eight inner playing stations disposed in inward abutting relationship with said eight middle playing stations;

(2) providing four sets of chess pieces;

(3) placing one said set of chess pieces in conventional starting arrangement upon said eight middle playing stations and said eight inner playing stations of each said side of said playing area;

(4) one said player disposed adjacent to each of two said sides of said playing area, wherein one said set of chess pieces belong to each said player;

(5) providing rules of play, said rules of play including:

conventional rules of chess play;

additional rules of play which modify said conventional rules of chess play, said additional rules of play including:

designating said sets of chess pieces disposed on two unoccupied sides of said playing area as common pieces which may be moved by both of said two players;

said two players and said two common pieces sequentially taking turns moving;

when it is each of said common pieces turn to move, said two players sequentially taking turns moving said common pieces; and, (6) said two players playing a modified game of chess in accordance with said rules of plays.

10. The method of claim 9, further including:

in step (5), said additional rules of play including putting a king into checkmate by one of (1) said pieces of said other player and one said set of common pieces, (2) said pieces of both said sets of common pieces, and (3) said pieces of said other player, and both said sets of common pieces.

11. The method of claim 9, further including:

in step (2), each said set of chess pieces including at least one master pawn; and, in step (5), said additional rules of play including said master pawn moving diagonally and capturing straight ahead.

12. The method of claim 9, further including:

in step (1), said playing area having four corner groups of said playing stations, each said corner group having four said playing stations arranged in a square configuration;

in step (5), said additional rules of play including one of:

(a) during play said chess pieces not allowed to occupy said playing stations of said four corner groups; and, (b) during play said chess pieces initially not allowed to occupy said playing stations of said four corner groups, but upon the occurrence of a predetermined event, said chess pieces being allowed to occupy said playing stations of said four corner groups.

13. A method for two players to play a modified game of chess, comprising:

(1) providing a playing area, said playing area having 144 playing stations arranged in a 12 by 12 matrix, said playing stations being of two alternating types, said playing area having four sides, each said side having 12 said playing stations;

(2) providing two, and only tw,o sets of chess pieces, each said set of chess pieces including:
16 pawns;
four rooks;
four knights;
four bishops;
only one king; and,
only one queen;

(3) one said player disposed adjacent to one said side of said playing area, and another said player disposed adjacent to another side of said playing area, one set of said chess pieces belonging to one said player and the another set of said chess pieces belonging to said other said player;

(4) said two players placing their chess pieces upon said playing area;

(5) providing rules of play, said rules of play including: conventional rules of chess play;

(6) said two players playing a modified game of chess in accordance with said rules of play;

in step (1), said playing area having four corner groups of said playing stations, each said corner group having four said playing stations arranged in a square configuration;

in step (5), said additional rules of play including one of:
(a) during play said chess pieces not allowed to occupy said playing stations of said four corner groups; and,
(b) during play said chess pieces initially not allowed to occupy said playing stations of said four corner groups, but upon the occurrence of a predetermined event, said chess pieces being allowed to occupy said playing stations of said four corner groups.

14. A method for two players, and only two players, to play a modified game of chess, comprising:

(1) providing a playing area, said playing area having 144 playing stations arranged in a 12 by 12 matrix, said playing stations being of two alternating types, said playing area having four sides, each said side having 12 said playing stations;

(2) providing four sets of chess pieces, each said set of chess pieces being distinguishable from each other said set of chess pieces;

(3) one said player disposed adjacent to one said side of said playing area, and another said player disposed adjacent to another side of said playing area, two sets of said chess pieces belonging to one said player and another two sets of said chess pieces belonging to said other player;

(4) said two players placing their chess pieces upon said playing area;

(5) providing rules of play, said rules of play including: conventional rules of chess play; and,
additional rules of play which modify the conventional rules of chess play, the additional rules of play including;
the game ending when both of a player's kings have been put into checkmate; and, (6) said two players playing a modified game of chess in accordance with said rules of play; and, in step (5), said additional rules of play including:
One of (1) when a king is checkmated, said player whose king is checkmated removing all his or her said chess pieces of the same color from said playing area, and (2) when a king is checkmated, said player whose king is checkmated removing said checkmated king from said playing area, and leaving all remaining said chess pieces of the same color as said checkmated king in place on said playing area.

15. The method of claim 14, further including:

in step (5), said additional rules of play including:
when said checkmated king is removed from said playing area, said removal counted as a move by said player.

16. A method for two players, and only two players, to play a modified game of chess, comprising;

(1) providing a playing area, said playing area having 144 playing stations arranged in a 12 by 12 matrix, said playing stations being of two alternating types, said playing area having four sides, each said side having 12 said playing stations;

(2) providing four sets of chess pieces, each said set of chess pieces being distinguishable from each other said set of chess pieces;

(3) one said player disposed adjacent to one said side of said playing area, and another said player disposed adjacent to another side of said playing area two sets of said chess pieces belonging to one said player and another two sets of said chess pieces belonging to said other player;

(4) said two players placing their chess pieces upon said playing area;

(5) providing rules of play, said rules of play including: conventional rules of chess play; and,
additional rules of play which modify the conventional rules of chess play, the additional rules of play including;
the game ending when both of a player's kings have been put into checkmate; and, (6) said two players playing a modified game of chess in accordance with said rules of play;

in step (1), said playing area having four corner groups of said playing stations, each said corner group having four said playing stations arranged in a square configuration;

in step (5), said additional rules of play including one of:
(a) during play said chess pieces not allowed to occupy said playing stations of said four corner groups; and,
(b) during play said chess pieces initially not allowed to occupy said playing stations of said four corner groups, but upon the occurrence of a predetermined event, said chess pieces being allowed to occupy said playing stations of said four corner groups.

17. A method for two players to play a modified game of chess, comprising;

(1) providing a playing area, said playing area having 144 playing stations arranged in a 12 by 12 matrix, said playing stations being of two alternating types, said playing area having four sides, each said side having 12 said playing stations eight of which are middle playing stations wherein two said playing stations are disposed on either side of said eight middle playing stations, each said side further having (1) eight first tier playing stations disposed in inward abutting relationship with said eight middle playing stations, (2) eight second tier playing stations disposed in inward abutting relationship with said eight first tier playing stations, and (3) eight third tier playing stations disposed in inward abutting relationship with said eight second tier playing stations;

(2) providing two sets of chess pieces;

(3) placing one said set of chess pieces in conventional starting arrangement upon said eight second tier playing stations and said eight third tier playing stations of two opposite sides of said playing area, so that said middle playing stations and said first tier playing stations are disposed behind said sets of chess pieces;

(4) said two players disposed adjacent to said two said sets of chess pieces;

(5) said two players playing a modified game of chess;

in step (1), said playing area having four corner groups of said playing stations, each said corner group having four said playing stations arranged in a square configuration;

in step (5), one of:

(a) during play said chess pieces not allowed to occupy said playing stations of said four corner groups; and, (b) during play said chess pieces initially not allowed to occupy said playing stations of said four corner groups, but upon the occurrence of a predetermined event, said chess pieces being allowed to occupy said playing stations of said four corner groups.

* * * * *